US006986312B2

(12) United States Patent
Martin et al.

(10) Patent No.: US 6,986,312 B2
(45) Date of Patent: Jan. 17, 2006

(54) PROCESS FOR MINIMIZING THE CONCENTRATION OF TOXIC ORGANIC POLLUTANTS IN FLY DUSTS

(75) Inventors: Johannes Martin, München (DE); Oliver Gohlke, München (DE)

(73) Assignees: Martin GmbH fur Umwelt-und Energietechnik, Munich (DE); Mitsubishi Heavy Industries, Ltd., Tokoyo (JP)

( * ) Notice: Subject to any disclaimer, the term of this patent is extended or adjusted under 35 U.S.C. 154(b) by 119 days.

(21) Appl. No.: 10/401,065

(22) Filed: Mar. 27, 2003

(65) Prior Publication Data

US 2003/0213417 A1 Nov. 20, 2003

(30) Foreign Application Priority Data

Mar. 27, 2002 (DE) ..... 102 13 787

(51) Int. Cl.
*F23J 11/00* (2006.01)
*F23C 9/00* (2006.01)

(52) U.S. Cl. ..... 110/345; 110/186; 110/204

(58) Field of Classification Search ..... 110/204, 110/345, 185, 186, 165 A, 165 R, 346; 588/205; 423/240 R
See application file for complete search history.

(56) References Cited

U.S. PATENT DOCUMENTS 4,844,875 A * 7/1989 Ettehadieh ..... 423/210
5,309,850 A * 5/1994 Downs et al. ..... 110/235
5,387,734 A * 2/1995 Hagenmaier et al. ..... 588/207
5,425,916 A * 6/1995 Beer et al. ..... 422/62
5,762,008 A * 6/1998 Martin et al. ..... 110/345
6,189,461 B1 * 2/2001 Miyazawa et al. ..... 110/345

* cited by examiner

*Primary Examiner*—Kenneth Rinehart
(74) *Attorney, Agent, or Firm*—Cohen, Pontani, Lieberman & Pavane

(57) ABSTRACT

The process for minimizing the concentration of toxic organic compounds in the fly dusts of incineration plants comprises, when special combustion conditions are detected which lead to the formation of organic pollutants, in particular dioxins/furans and/or precursor compounds of dioxins/furans, recirculating the fly dusts produced in the incineration plant to the combustion process for destruction of these compounds.

18 Claims, 1 Drawing Sheet

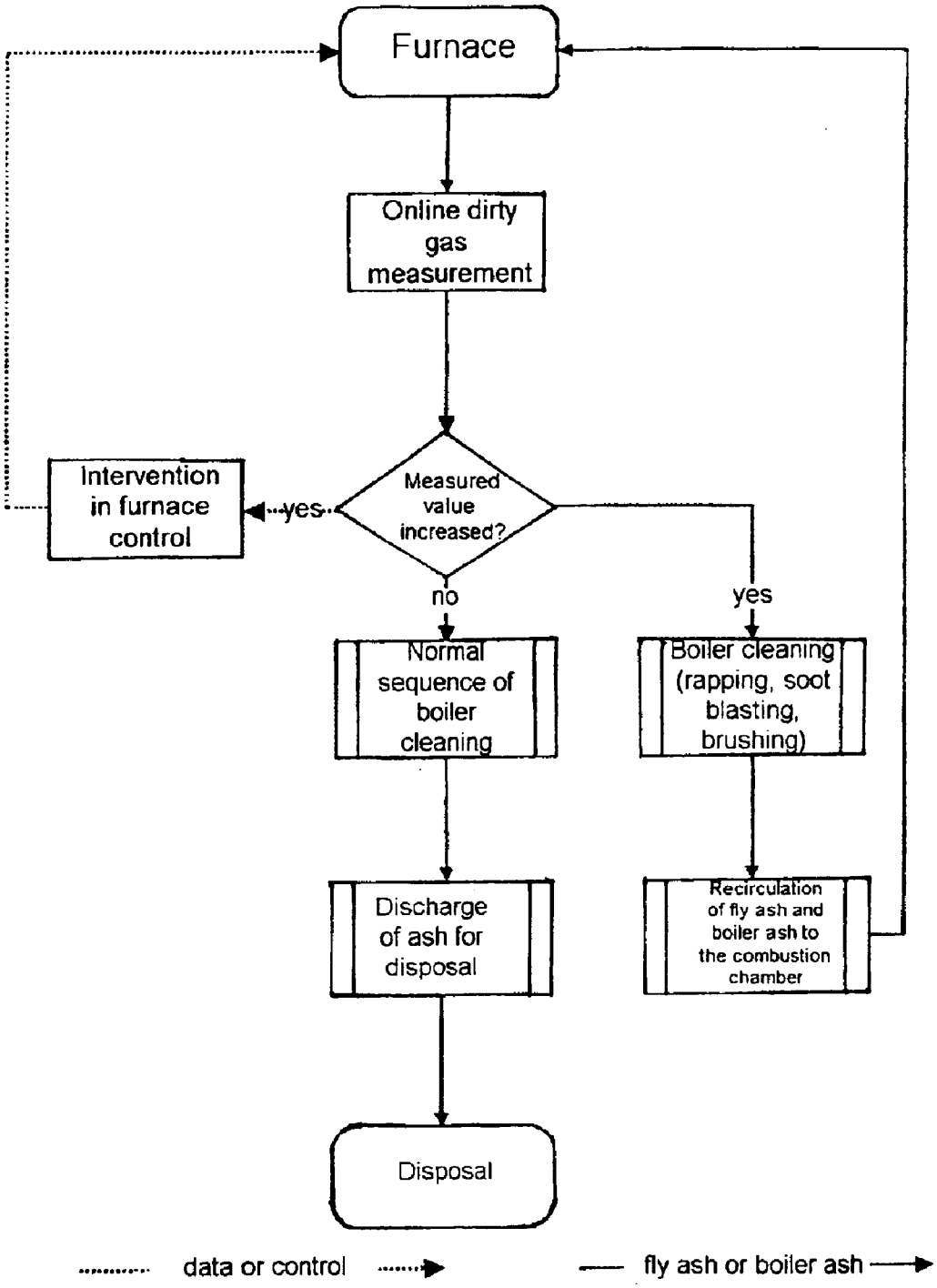
Furnace
Online dirty gas measurement
Measured value increased?
yes
Intervention in furnace control
no
yes
Normal sequence of boiler cleaning
Boiler cleaning (rapping, soot blasting, brushing)
Discharge of ash for disposal
Recirculation of fly ash and boiler ash to the combustion chamber
Disposal
data or control
fly ash or boiler ash

PROCESS FOR MINIMIZING THE CONCENTRATION OF TOXIC ORGANIC POLLUTANTS IN FLY DUSTS

BACKGROUND OF THE INVENTION

1. Field of the Invention

The invention relates to a process for minimizing the concentration of toxic organic pollutants in the fly dusts of incineration plants, in particular waste incineration plants, in which, at time intervals, at least a part of the fly dusts produced in the incineration plant is recirculated to the incineration process.

2. Description of the Related Art

The toxic organic pollutants in the fly dusts are, in particular, polychlorinated dibenzodioxins (PCDDs), polychlorinated dibenzofurans (PCDFs), precursor compounds, that is to say precursors of PCDDs and PCDFs, for example mono- and dichlorobenzene, polychlorinated biphenyls (PCBs) and further compounds which are comparable in structure or activity. These organic pollutants are frequently described and quantified in summary form in the literature and emissions legislation using an internationally employed toxicity equivalent in ng per kg of fly dust (ng I-TEQ/kg). The I-TEQ here is based on an equivalent toxicity of the sum of a multiplicity of organic pollutants to the seveso dioxin 2,3,7,8-tetrachlorodibenzodioxin.

EP 0 862 019 A1 discloses recirculating at least a part of the fly dusts exiting from the incineration plant to the high-temperature region of the incineration plant in order to induce vitrification and sintering of the dusts, so that the products obtained by this process can be added back to the grate ash or used separately.

The amount of fly dust remaining can thereby be reduced. The fly dusts are obtained by cleaning the boiler or by removal from the filter systems and, when a grate firing is used, recirculated to the combustion chamber of the incineration plant above the combustion bed. This process does not take into account the presence of toxic compounds, for example dioxins or precursors.

DE 33 20 466 C3 also discloses recirculating fly dusts into the combustion chamber of an incineration plant. Here the fly dusts are chemically treated before the recirculation with the purpose of reducing the pollutants outside the combustion chamber of the incineration plant. Therefore a low-pollutant fraction of the fly dusts is recirculated which is then incorporated into the slag in a high-temperature process.

SUMMARY OF THE INVENTION

It is an object of the invention to control the recirculation of fly dusts to the incineration process in such a manner that as large a proportion as possible of precursors or other organic pollutants is destroyed and thus the amount of toxic organic compounds which leave the incineration plant together with the fly dusts is minimized.

This object is achieved by recirculating fly dusts in dependence on special combustion conditions in which toxic organic pollutants such as PCDDs and PCDFs and/or precursor compounds, that is to say precursors of PCDDs and PCDFs, are formed to an increased extent.

According to this procedure, fly dusts are always specifically taken off when, on account of special combustion conditions, the precursors or other toxic organic pollutants to be minimized as far as possible are present to an increased extent. This is particularly important, therefore, because precursor compounds remain stuck to the contact heating surfaces of the steam generator downstream of the combustion process, which heating surfaces have a certain temperature, for example from 200 to 400° C., and, in particular in the presence of copper, soot and chlorine, are converted to dioxins/furans. The conversion reaction can proceed within a few minutes to a few hours, depending on the prevailing temperature conditions and the concentration of the substances copper, chlorine and soot acting as catalysts and reaction partners.

In an advantageous manner, the recirculation of the fly dusts is performed as a function of measured values detected in the exhaust gas of the incineration plant, which measured values are influenced by the combustion process.

In a particularly simple manner, the measured values used can be the concentration of carbon monoxide or oxygen in the exhaust gas, the combustion air excess or the temperature in the combustion chamber.

In modern waste incineration plants, the concentration of carbon monoxide in normal incineration operation is approximately 5 to 20 mg/m$^3$, whereas a CO content above 100 mg/m$^3$ would be considered as a special combustion condition and would trigger intervention in the meaning of the invention.

It is further advantageous to use the oxygen content in the exhaust gases as one of the measured values, more precisely in particular when in waste incineration plants the oxygen content falls below 5% by volume of $O_2$ or, when the air excess is being measured, the excess air factor of the combustion falls below $\lambda$=1.4. Also, the temperature in the combustion chamber of the incineration plant can be used as one of the measured values if this falls below 800° C. measured at approximately 6 to 10 meters in height above the main combustion zone.

In an advantageous manner, in a development of the invention the fly dusts can be recirculated as a function of organic pollutants, in particular PCDDs/PCDFs, and precursors thereof detected in the exhaust gas of the incineration plant.

In an advantageous manner, the measured values are determined by online analysis in the exhaust gas.

In particular, the fly dusts are recirculated as a function of a preset I-TEQ limit value. In this case the threshold value which defines the special combustion conditions could be selected between 0.1 and 5 ng I-TEQ/m$^3$ of exhaust gas.

This measurement will preferably comprise not only gaseous but also particle-bound organic pollutants and take place at the boiler end or before the exhaust gas cleaner in the dirty gas. Suitable methods for this are, for example, analytical methods described in the literature such as Resonance Enhanced Multiple Photon Ionization and Time of Flight Mass Spectrometry (REMPITOFMS), which permit direct online analysis of, for example, monochlorobenzene. Here values known from experience show that monochlorobenzene correlates very well with I-TEQ in the exhaust gas. Such an online measuring instrument can therefore also be termed TEQ sensor. However, according to the invention, other sensors for other molecules or groups of substances can also be used if the signal of these sensors correlates characteristically with the content of toxic organic pollutants in the exhaust gas.

In an advantageous further development of the invention, the fly dusts are recirculated during a settable time period after the special combustion conditions have been detected. Here, in particular, values from experience play a role.

Preferably, the fly dusts are recirculated for a time period of 10 minutes to 6 hours after the special combustion conditions have been detected. The recirculation period for the fly dusts can also be set as a function of the level of the measured values.

If, to determine the special combustion conditions, analytical instruments are used which make rapid determination of the measured value possible (as is the case with the abovementioned measurement techniques and measured values), then it is expedient in a further embodiment of the invention to set the recirculation period for the fly dusts as a function of the height of the measured value. A significant exceedence of the preset threshold value would therefore cause a longer recirculation period than a low exceedence.

To achieve reliable destruction of the toxic organic compounds or precursors, it is advantageous in a development of the invention if the fly dusts are recirculated to the main temperature region of the incineration plant.

When a grate firing is used as incineration plant, advantageously, the fly dusts can be recirculated to the combustion bed of the main combustion zone.

If the fly dusts are recirculated after detection of the special combustion conditions or during of after boiler cleaning, the fly dusts do not remain stuck to the boiler tubes during this operating period and there the precursors present in the fly dusts cannot react to form dioxins. Not only the fly dusts produced, but also the dust agglomerates produced are subject to the recirculation.

The boiler is cleaned by rapping, brushing or soot blasting.

It is advisable to recirculate the fly dusts which are produced in an exhaust gas emission control system downstream of the steam generator. This measure is performed when special combustion conditions are detected.

The fly dusts produced in the filter systems downstream of the steam generator can in addition be recirculated in a manner according to the invention when special combustion conditions are detected.

Obviously, the operator of an incineration plant will always additionally strive to eliminate the special combustion conditions as quickly as possible by suitable measures if this is not performed automatically, for example by control of combustion.

In the event that no faults in the course of combustion and thus also no special combustion conditions are detectable, the boiler is cleaned in the normal cycle. In this case, frequently a time period between two cleaning phases of about 4 hours is used. The fly dusts then arising are passed on into the normal disposal path.

BRIEF DESCRIPTION OF THE DRAWINGS

The sole FIGURE is a flow chart which illustrates the method according to the invention.

DETAILED DESCRIPTION OF THE PREFERRED EMBODIMENTS

As can be seen from this flow chart, an online dirty gas measurement is first carried out, for example of a toxic organic pollutant, of CO or a representative temperature in the exhaust gas of the combustion. If here special combustion conditions due to an increased concentration of organic pollutants, CO or a large deviation of the temperature from the preset value are detected, from a preset exceedence or deviation, boiler cleaning is carried out by means of rapping, brushing or soot blasting, and the resultant fly dusts or fly ashes are recirculated to the incineration plant. If, in contrast, no fault is detected, that is to say special combustion conditions are not present, the customary boiler cleaning is carried out at normal time intervals. The resultant fly ash is ejected from the process for disposal.

What is claimed is:

1. A process for minimizing the concentration of toxic organic compounds in the fly dust of an incineration plant, said process comprising:

detecting when special combustion conditions are present, said special combustion conditions comprising toxic organic pollutants present in combustion products produced by an incineration plant exceeding predetermined amounts, said combustion products comprising exhaust gas and fly dusts, said toxic organic pollutants comprising at least one of PCDD's, PCDF's, precursors of PCDD's, and precursors of PCDF's, and recirculating at least part of said fly dusts to said incineration plant when said special combustion conditions are detected, wherein said fly dusts are recirculated as a function of a preset I-TEQ limit value for organic pollutants detected in the exhaust gas.

2. A process as in claim 1 wherein said fly dusts are recirculated for a settable time period after the special combustion conditions have been detected.

3. A process as in claim 2 wherein said settable time period is 10 minutes to 6 hours.

4. A process as in claim 1 wherein said fly dusts are recirculated to a main combustion zone of the incineration plant.

5. A process as in claim 4 wherein said main combustion zone comprises a combustion bed used for grate firing, said fly dusts being recirculated to said combustion bed.

6. A process as in claim 1 wherein the fly dusts are recirculated after said special combustion conditions have been detected.

7. A process as in claim 1 wherein said fly dusts are recirculated in an emission control system downstream of a steam generator.

8. A process for minimizing the concentration of toxic organic compounds in the fly dust of an incineration plant, said process comprising:

detecting when special combustion conditions are present, said special combustion conditions comprising toxic organic pollutants present in combustion products produced by an incineration plant exceeding predetermined amounts, said combustion products comprising exhaust gas and fly dusts, said toxic organic pollutants comprising at least one of PCDD's, PCDF's, precursors of PCDD's, and precursors of PCDF's, and recirculating at least part of said fly dusts to said incineration plant when said special combustion conditions are detected, said fly dusts being recirculated for a settable time period after the special combustion conditions have been detected.

9. A process as in claim 8 comprising:

detecting measured values of said exhaust gas which are influenced by the combustion process, and recirculating said fly dust as a function of said measured values.

10. A process as in claim 9 wherein said measured values comprise at least one of concentration of carbon monoxide, concentration of oxygen, excess combustion air, and temperature in the combustion chamber.

11. A process as in claim 9 wherein said measured values are measured by analyzing said exhaust gas online.

12. A process as in claim 9 wherein said fly dusts are recirculated for a period which is a function of the magnitude of the measured values.

13. A process as in claim 8 wherein said fly dusts are recirculated as a function of organic pollutants detected in the exhaust gas.

14. A process as in claim 13 wherein said fly dusts are recirculated as a function of a preset I-TEQ limit value.

15. A process as in claim 14 wherein said I-TEQ limit value is selected between 0.1 and 5 ng I-TEQ/$m^3$ of exhaust gas.

16. A process for minimizing the concentration of toxic organic compounds in the fly dust of an incineration plant, said process comprising:

detecting when special combustion conditions are present, said special combustion conditions comprising toxic organic pollutants present in combustion products produced by an incineration plant exceeding predetermined amounts, said combustion products comprising exhaust gas and fly dusts, said toxic organic pollutants comprising at least one of PCDD's, PCDF's, precursors of PCDD's, and precursors of PCDF's, recirculating at least part of said fly dusts to said incineration plant when said special combustion conditions are detected, and cleaning said boiler and recirculating said fly dusts during or after boiler cleaning.

17. A process as in claim 16 wherein said boiler cleaning comprises at least one of rapping, brushing, and soot blasting.

18. A process for minimizing the concentration of toxic organic compounds in the fly dust of an incineration plant, said process comprising:

detecting when special combustion conditions are present, said special combustion conditions comprising toxic organic pollutants present in combustion products produced by an incineration plant exceeding predetermined amounts, said combustion products comprising exhaust gas and fly dusts, said toxic organic pollutants comprising at least one of PCDD'S, PCDF's, precursors of PCDD's, and precursors of PCDF's, detecting measured values of said exhaust gas which are influenced by the combustion process, and recirculating at least part of said fly dusts to said incineration plant when said special combustion conditions are detected, and as a function of said measured values, said fly dusts being recirculated for a period which is a function of the magnitude of the measured values.

* * * * *